United States Patent [19]

Nakayama et al.

[11] Patent Number: 4,996,140

[45] Date of Patent: Feb. 26, 1991

[54] SILVER HALIDE PHOTOGRAPHIC MATERIAL

[75] Inventors: Tomoyuki Nakayama; Hiroyuki Hoshino; Hirofumi Ohtani; Syoji Matsuzaka, all of Hino, Japan

[73] Assignee: Konica Corporation, Tokyo, Japan

[21] Appl. No.: 362,126

[22] Filed: Jun. 6, 1989

[30] Foreign Application Priority Data

Jun. 8, 1988 [JP] Japan ..... 63-140785

[51] Int. Cl.[5] ..... G03C 1/035; G03C 1/10

[52] U.S. Cl. ..... 430/569; 430/567; 430/570

[58] Field of Search ..... 430/567, 569, 570

[56] References Cited

U.S. PATENT DOCUMENTS 4,225,666 9/1980 Locker et al. ..... 430/569

4,828,972 5/1989 Ihama et al. ..... 430/596

*Primary Examiner*—Richard L. Schilling

*Assistant Examiner*—Janet C. Baxter

*Attorney, Agent, or Firm*—Finnegan, Henderson, Farabow, Garrett and Dunner

[57] ABSTRACT

A silver halide photographic material having silver halide emulsion layers, at least one of which contains a silver halide emulsion that has been prepared in such a way that a spectral sensitizing dye is added after 85 wt % of the soluble silver salt in solution that is to be added during ripening of silver halide emulsion has been added but before the start of a desalting step, and that a spectral sensitizing dye which may be the same or different from the first added dye is added during the desalting step.

22 Claims, No Drawings

SILVER HALIDE PHOTOGRAPHIC MATERIAL

BACKGROUND OF THE INVENTION

The present invention relates to a silver halide photographic material, in particular, one which is improved in spectral sensitivity, keeping quality and resistance to blackening under pressure.

Silver halides have an inherent light absorption band which is usually within the blue to ultraviolet regions but not within the green or red region. Thus, silver halides inherently lack sensitivity to green and red light, or their sensitivity to these lights is too small to achieve high efficiency. To cope with this situation, it is common practice in the art of silver halide photographic material to incorporate in photographic emulsions those organic dyes which have a light absorption band in the visible range (the infrared range in the case of infrared light-sensitive materials) so that their sensitivity will be extended to the visible or infrared range by having those organic dyes adsorbed on the silver halide grains. This technique is referred to as "spectral sensitization" and the dyes used are called "spectral sensitizing dyes" or simply "spectral sensitizers". The demand for higher sensitivity in modern photographic materials may be translated as the requirement for improvement in the sensitivity achieved by "spectral sensitization" or "spectral sensitivity".

The production of silver halide emulsions generally proceeds through the steps of forming silver halide grains, physical ripening, desalting, chemical sensitization, etc. Spectral sensitizers may be added at various stages of the production process, and three approaches have been taken in the prior art. According to the first approach, spectral sensitizers are added after chemical sensitization and before coating, as described in U.S. Pat. No. 4,425,426, prior to chemical sensitization, or during chemical sensitization. In the second approach, spectral sensitizers are added during the growth of grains (during physical ripening) as described in U.S. Pat. Nos. 2,735,766, 3,628,960, 4,183,756 and 4,225,666, as well as in No. JP-A-55-26589 and No. JP-A-58-184142 (the term "JP-A" as used herein means an "unexamined published Japanese patent application"). The third approach consists of adding spectral sensitizers both in the latter period of grain growth where the change in the shape of grains is substantially absent and after grain formation but before the desalting step, as described in Nos. JP-A-61-103149 and 61-196238.

The first approach, however, has had the problem that on account of weak adsorption of dyes onto silver halides, the technique is only applicable to the case where dyes capable of efficient spectral sensitization and having high adsorption power are to be used. The second approach which involves adding dyes in the process of grain formation is also disadvantageous in that the dyes will be adsorbed on the surfaces of growing grains, thereby interfering with normal crystal growth.

In spectral sensitization of silver halide emulsions, more than one dye is normally used to make emulsions having sensitivity in a certain wavelength range (say, green light), but with such systems using combined dyes, it is impossible to attain optimum spectral sensitization by merely increasing the absorption power of the dyes. As is well known, the interaction between dyes and silver halide grains is not the sole factor that govern systems that use several dyes in combination and the relationship with the interaction between different dyes will influence the efficiency of spectral sensitization by a great degree (see, for example, Chapter 10 of "The Theory of Photographic Process", 4th Ed., Macmillan Publishing Company, 1977). Therefore, optimum spectral sensitization requires the choice of not only optimum relationship between dyes but also optimum adsorption between dyes and the surfaces of silver halides. According to the results of the study conducted by the present inventors, the second and third conventional methods of adding spectral sensitizers involve considerable difficulty in improving the efficiency of spectral sensitization by controlling dyes so that they will be adsorbed onto silver halide grains in an optimal state. It was also found that these methods caused a negative effect in that resistance to blackening under pressure deteriorates.

Japanese Patent Application No. 62-119381 describes a technique of spectral sensitization that consists of adding dyes during the desalting step. This technique solves to some extent the problems described in the previous paragraph in association with the second and third approaches but on the other hand, the power of adsorption between dyes and silver halide grains is still insufficient to provide satisfactory improvement in resistance to blackening under pressure after storage in a hot and humid atmosphere.

SUMMARY OF THE INVENTION

An object, therefore, of the present invention is to provide a silver halide photographic material that is free from the problems associated with the prior art and which is improved not only in the efficiency of spectral sensitization but also in keeping quality and resistance to blackening under pressure.

This object of the present invention can be attained by a silver halide photographic material having silver halide emulsion layers, at least one of which contains a silver halide emulsion that has been prepared in such a way that a spectral sensitizing dye is added after 85 wt % of the soluble silver salt in solution that is to be added during ripening of silver halide emulsion has been added but before the start of a desalting step, and that a spectral sensitizing dye which may be the same or different from the first added dye is added during the desalting step (the so prepared emulsion is hereinafter sometimes referred to as the "emulsion of the present invention").

The silver halide photographic material of the present invention containing the particular emulsion described above in at least one silver halide emulsion layer offers the advantages of high sensitivity, good keeping quality and improved resistance to blackening under pressure.

DETAILED DESCRIPTION OF THE INVENTION

The silver halide photographic material of the present invention has one or more silver halide emulsion layers, which may be present on one or both sides of a base support. At least one of such silver halide emulsion layers must contain the emulsion of the present invention described above.

In order to prepare the emulsion of the present invention, a spectral sensitizing dye must be added at two points of time, one being the time after 85 wt % of the soluble silver salt in solution that needs to be added has been added but before the start of a desalting step, and the other being during the desalting step. The term "desalting step" as used herein means a step that is performed to remove soluble salts after the formation of emulsion grains has been completed (i.e., after formation of precipitates or physical ripening).

Silver halide emulsions are commonly prepared by a process that comprises, in sequence, the formation of silver halide grains (by such means as double dissolution of soluble silver salts and soluble halides in an aqueous gelatin solution), physical ripening, desalting and chemical sensitization. After the formation of silver halides is completed, namely, after formation of precipitates or after completion of physical ripening, soluble salts are removed and this practice is generally referred to as a desalting step.

In the desalting step, a ordinary series of operations consisting of addition of a desalting agent, standing and decantation are performed at least once, typically repeated several times, and in the usual case, post-gelatin (to be described hereinafter) is thereafter added to form a dispersion. After these procedures have been completed, chemical sensitization is started. The term "desalting step" as used herein will cover the steps that are to be performed after the formation of precipitates or physical ripening but before chemical sensitization is started (i.e., up to the time of addition of post-gelatin and completion of dispersing step).

Various methods of desalting have been used and the two classic and established techniques are noodle washing and flocculation. Noodle washing involves gelation of gelatin, and the flocculation method employs inorganic salts composed of polyvalent anions (such as sodium sulfate and other sulfate salts), anionic surfactants, anionic polymers (e.g. polystyrenesulfonic acid), and gelatin derivatives (e.g. aliphatic acylated gelatin, aromatic acylated gelatin and aromatic carbamoylated gelatin).

In preferred desalting methods, sulfates ($MgSO_4$, $NaSO_4$, etc.) or anionic polymers [polystyrylsulfonic acid type polymers as described in No. JP-B-35-16086 (the term "JP-B" as used herein means an "examined Japanese patent publication"], or vinyl polymers having a carboxylic acid in side chains as described in No. JP-A-62-32445) are used as desalting agents.

When preparing the emulsion of the present invention, a spectral sensitizing dye may be added at any point of time as long as it is added after 85 wt % of the soluble silver salt in solution that needs to be added has been added but before a desalting step is started. In order to ensure that the spectral sensitizing dye added will not interfere with normal grain growth, the timing of addition is preferably adjusted to be within the period from the time around which the formation of grains is substantially completed to the time when the desalting step is started.

A spectral sensitizing dye is also added during the desalting step and the timing of its addition is arbitrary as long as it is added during the desalting step. Preferably, it is added before the addition of post-gelatin, or gelatin which is added after desalting to re-disperse silver halide grains.

If flocculation is adopted as a desalting method, it is more preferred to add a spectral sensitizing dye during the step of "washing emulsion", in which the supernatant obtained by precipitating grains is discharged, and water is added to the precipitate, and the resulting mixture is stirred.

A spectral sensitizing dye which may be the same or different from the one added as described above may be added to the resulting silver halide grains prior to and/or after chemical sensitization. It should, however, be noted that the addition of such sensitizing dyes is not absolutely necessary for the purpose of attaining the object of the present invention. The term "prior to chemical sensitization" means the time that is immediately after completion of re-dispersing with post-gelatin following desalting but before the addition of a chemical sensitizer, and the term "after chemical sensitization" means the time after completion of chemical sensitization.

A spectral sensitizing dye may also be charged into the reaction vessel for the formation of silver halide grains before the start of addition of a solution of soluble silver salt and/or a solution of soluble halide but before 85 wt % of the soluble silver salt in solution that needs to be added has been added.

Spectral sensitizing dyes may be added by various methods, for example, by adding them as solutions in water or organic solvents. Substantially water-insoluble spectral sensitizing dyes may be used as dispersions in water-insoluble solvents. Spectral sensitizing dyes that are to be added during ripenings of emulsions and during the desalting step may be added, with appropriate amounts being added either all at once or in divided portions. If desired, they may be added continuously over a certain period of time.

The proportions of spectral sensitizing dyes that are added at the two points of time described above i.e., during ripening of emulsion and during desalting are not limited to any particular values but preferably, at least 50% of the total amount of spectral sensitizing dyes to be added is occupied by the spectral sensitizing dye that is added in the desalting step. A more preferred amount is at least 80%. In accordance with the present invention, spectral sensitizing dyes are used in amounts that range preferably from $5\times10^{-7}$ to $1\times10^{-1}$ mole per mole of AgX, with the range of $5\times10^{-6}$–$1\times10^{-2}$ mole per mole of AgX being particularly preferred.

While various spectral sensitizing dyes may be employed, typical examples are cyanine dyes, merocyanine dyes, complex cyanine dyes, complex merocyanine dyes, holopolar cyanine dyes, hemicyanine dyes, styryl dyes, and hemioxanol dyes.

Particularly useful dyes are cyanine, merocyanine and complex merocyanine dyes. These dyes may contain any of those nuclei which are commonly applied as basic heterocyclic nuclei to cyanine dyes, and specific examples of such nuclei include: pyrroline, oxazoline, thiazoline, pyrrole, oxazole, thiazole, selenazole, imidazole, tetrazole, pyridine and those nuclei having alicyclic hydrocarbon rings fused to these nuclei; and those nuclei having aromatic hydrocarbon rings fused to these nuclei, as in the case of indolenine, benzindolenine, indole, benzoxazole, naphthoaxazole, benzothiazole, naphthothiazole, benzoselenazole, benzimidazole, quinoline nuclei, etc. All of these nuclei may be substituted on carbon atoms.

Merocyanine or complex merocyanine dyes may contain 5- or 6- membered heterocyclic nuclei as nuclei having a ketomethylene structure and examples of such nuclei are pyrazolin-5-one, thio-hydantoin, 2-thioxazolidine-2, 4-dione, thiazoline-2, 4-dione, rhodanine, thiobarbituric acid nuclei, etc.

The spectral sensitizing dyes described above may be used either on their own or as admixtures. In combination with spectral sensitizing dyes, sensitizing dyes that inherently lack spectral sensitizing action or those substances which substantially lack the ability to absorb visible light and which exhibit supersensitization may be added. For example, the dyes that are listed on pages 22–24 of Research Disclosure (RD) No. 17643 and in the right column of page 648 onward of RD No. 18716 may preferably be used.

The silver halide grains in the emulsion of the present invention may have any composition selected from among silver chloroiodobromide, silver chloride, silver chlorobromide, silver bromide, silver iodobromide, silver iodide, etc. These silver halide grains preferably have an average grain size of 0.05–8.0 μm, more preferably in the range of 0.2–3.0 μm. The silver halide grains may have any desired internal structure but multilayered grains of the type described in No. JP-A-61-245151 are preferred.

A preferred method of making silver halide grains is described in Japanese Patent Application No. 62-3435 with reference to the manufacture of an emulsion having a mixed crystal within and/or between silver halide grains. According to this method, silver halide grains having a solubility product less than the minimum solubility product in the silver halide as the component of said mixed crystal are allowed to be present until the supply of silver halide producing iodine for creating said mixed crystal is completed.

The emulsion of the present invention may be mono- or poly-dispersed but it is preferably a monodispersed emulsion. The making of a monodispersed emulsion starts with the growth of crystal grains. For grain growth, solutions of silver ions and halides may be added alternately but more preferably they are added by the "double-jet method". In obtaining monodispersed emulsions, it is particularly preferred that seeds are used as growth nuclei while silver ions and halide ions are supplied to increase the size of grains. The broader the grain size distribution of seeds, the broader will be the size distribution of grown grains. Hence, in order to attain a monodispersed emulsion, it is preferred to use seeds having a narrow grain size distribution.

The emulsion of the present invention may be subjected to various types of chemical sensitization that are normally employed in the art. This is also true with emulsions that may be used in combination with the emulsion of the present invention to produce the silver halide photographic material of the present invention. For applicable methods of chemical sensitization, reference may be had to H. Frieser, ed., Die Grundlagen der Photographische Prozesse mit Silberhalogeniden, Akademische Verlagsgesellschaft, 1968, pp. 675–734. Among the methods that can be employed are sulfur sensitization which uses sulfur-containing compounds or activated gelatin which are capable of reacting with silver ions, reduction sensitization which uses reducing substances, and noble metal sensitization which uses gold or other noble metal compounds. These methods may be used either on their own or as admixtures. Exemplary sulfur sensitization include thiosulfates, thioureas, thiazoles, rhodanines, etc. and specific examples of these compounds are described in U.S. Pat. Nos. 1,574,944, 2,410,689, 2,278,947, 2,728,668, 3,656,955, 4,032,928 and 4,067,740. Exemplary reduction sensitizers include stannous salts, amines, hydrazine derivatives, formamidine sulfinic acid, silane compounds, etc. and specific examples of these compounds are described in U.S. Pat. Nos. 2,487,850, 2,419,974, 2,518,698, 2,983,609, 2,983,610, 2,694,637, 3,930,867, and 4,054,458. Besides gold complex salts, complex salts of metals of Group VIII of the periodic table (e.g. platinum, iridium and palladium) may be used in noble metal sensitization and specific examples of usable compounds are described in U.S. Pat. Nos. 2,399,083, 2,448,060, British Patent No. 618,061.

In the practice of the present invention, two or more of the chemical sensitization methods described above may be combined.

There is no particular limitation on silver deposit and the preferred range is from 1,000 to 15,000 mg/m$^2$, with the range of 2,000–10,000 mg/m$^2$ being more preferred.

Various dopants may be added when forming the silver halide emulsion of the present invention. Examples of such internal dopants include silver, sulfur, iridium, gold, platinum, osmium, rhodium, tellurium, selenium, cadmium, zinc, lead, thallium, iron, antimony, bismuth and arsenic. If grains to be doped are composed of multiple layers of shell, water-soluble salts or complex salts of dopants may be allowed to be present when forming the shells.

Hydrophilic colloids that are commonly employed in silver halide emulsions may be used as binders in the making of the emulsion of the present invention or as dispersion media that are to be used in the manufacture of such the emulsion. Besides gelatin (which may be lime- or acid- processed), various gelatin derivatives may be used as hydrophilic colloids. Exemplary gelatin derivatives are mentioned below: those which are prepared by reacting gelatin with aromatic sulfonyl chloride, acid chlorides, acid anhydrides, isocyanates or 1,4-diketones as described in U.S. Pat. No. 2,614,928; those which are prepared by reacting gelatin with trimellitic anhydride as described in U.S. Pat. No. 3,118,766; those which are prepared by reacting gelatin with organic acids having active halogens as described in No. JP-B-39-5514; those which are prepared by reacting gelatin with aromatic glycidyl ether as described in No. JP-B-42-26845; those which are prepared by reacting gelatin with maleimide, maleamic acid, unsaturated aliphatic diamide, etc. as described in U.S. Pat. No. 3,186,846; the sulfoalkylated gelatin described in British Patent No. 1,033,189; polyoxyalkylene derivatives of gelatin as described in U.S. Pat. No. 3,312,553; gelatin to which are grafted high-molecular weight compounds such as those prepared by grafting onto gelatin one or more monomers selected from among acrylic acid, methacrylic acid, esters thereof with mono- or polyhydric alcohols, amides, (meth)acrylonitrile, styrene, and other vinyl monomers. Other hydrophilic colloids that may be employed include synthetic hydrophilic high-molecular weight substances as illustrated by homopolymers composed of such monomers as vinyl alcohol, N-vinylpyrrolidone, hydroxyalkyl (meth)acrylates, (meth)acryl-amides and N-substituted (meth)acrylamides, copolymers of these monomers, copolymers thereof with (meth)acrylic acid esters, vinyl acetate or styrene, and copolymers of those monomers with maleic anhydride, maleamic acid and other monomers. Also useful as hydrophilic colloids are non-gelatinous natural hydrophilic high-molecular weight substances as illustrated by casein, agar, alginic acid and other polysaccharides. The hydrophilic colloids listed above may be used either on their own or as admixtures.

The silver halide emulsion of the present invention may incorporate various common additives depending on object. Illustrative additives that may be added include: azoles such as imidazoles (e.g. benzothiazolium salts, nitrosoindazoles, nitrobenzimidazoles, chlorobenzimidazoles, bromobenzimidazoles, mercaptothiazoles, mercaptobenzothiazoles, mercaptobenzimidazoles, and mercaptothiadiazoles), triazoles (e.g. aminotriazoles, benzotriazoles and nitrobenzotriazoles), tetrazoles (e.g. mercaptotetrazoles, in particular, 1-phenyl-5- mercaptotetrazole); mercaptopyrimidines such as thioketo compounds (e.g. oxazoline thion); azaindenes such as triazaindenes, tetrazaindenes (in particular, 4-hydroxy-substituted (1,3,3a,7) tetrazaindene), and pentazaindenes; as well as stabilizers and antifoggants that are exemplified by benzenethiosulfonic acid, benzenesulfinic acid, benzenesulfonic acid, amides, imidazolium salts, tetrazolium salts and polyhydroxy compounds.

The silver halide photographic material of the present invention may incorporate inorganic or organic hardeners in photographic emulsion layers and other hydrophilic colloidal layers. Exemplary hardeners include: chromium salts (e.g. chromium alum and chromium acetate), aldehydes (e.g. formaldehyde, glyoxal and glutaraldehyde), N-methylol compounds (e.g. dimethylolurea and methylol dimethylhydantoin), dioxane derivatives (e.g. 2,3-dihydroxydioxane), activated vinyl compounds (e.g. 1,3,5-triacryloyl-hexahydro-S-triazine and 1,3-vinylsulfonyl-2-propanol), activated halogen compounds (e.g. 2-4-dichloro-6-hydroxy -S-triazine), and mucohalogen acids (e.g. mucochloric acid and mucophenoxychloric acid). These compounds may be used either on their own or as admixtures.

The silver halide photographic material of the present invention may further contain dispersions of water-insoluble or slightly water-soluble synthetic polymers in photographic emulsion layers and other hydrophilic colloidal layers for various purposes such as improvement in dimensional stability. Examples of such polymers are those which comprise monomer components selected from among alkyl (meth)acrylates, alkoxyalkyl (meth)acrylates, glycidyl (meth)acrylates, (meth)acrylamide vinyl esters (e.g. vinyl acetate), acrylonitrile, olefins and styrene, which may be used either on their own or as admixtures, or which may be combined with monomers such as acrylic acid, methacrylic acid, $\alpha$, $\beta$-unsaturated dicarboxylic acids, hydroxyalkyl (meth-)acrylates, sulfoalkyl (meth)acrylates, and styrenesulfonic acid.

The silver halide photographic material of the present invention may optionally contain various additives such as development accelerators (e.g. benzyl alcohol and polyoxyethylene type compounds), image stabilizers (e.g. chroman, chraman, bisphenol and phosphorus ester type compounds), lubricants (e.g. wax, glycerides of higher aliphatic acids, and higher alcohol esters of higher aliphatic acids), development regulators, development agents, plasticizers and bleaching agents. Various types of surfactants, including anionic, ationic, nonionic and amphoteric types, may be used as coating aids or antifoaming agents, to improve the permeability of the photographic material for processing solutions or to control various physical properties of the photographic material. Compounds that are effective as antistats are diacetyl cellulose, styrene/perfluoroalkyl sodium maleate copolymers, and alkali salts of the product of reaction between styrene/maleic anhydride copolymer and p-aminobenzenesulfonic acid. Suitable matting agents include poly(methyl methacrylate), polystyrene and alkali-soluble polymers. Colloidal silicon oxide is also useful as a matting agent. Latices may be added to provide improved film properties and examples are copolymers of acrylate esters or vinyl esters with other monomers having an ethylene group. Exemplary gelatin plasticizers include glycerin and glycolic compounds. Exemplary thickeners include a styrene/sodium maleate copolymer and alkyl vinyl ether/maleic acid copolymers.

In accordance with the present invention, wide latitude can be obtained by mixing at least two types of emulsion having different average grain sizes and sensitivities or by coating them in superposition.

The silver halide photographic material of the present invention may be employed effectively in various fields of use including black-and-white photography, X-ray photography, color photography, infrared photography, microphotography, silver dye bleach process, reversal process, diffusion transfer process, high-contrast photography, photothermography, etc. A particularly advantageous use is in high-sensitivity color photographic materials.

In order to apply the present invention to monochromatic or multi-color photographic materials, the emulsion of the present invention may be rendered sensitive to red, green and/or blue light. If two or more emulsions are to be used, at least one of them needs to be the emulsion of the present invention. The present invention is also applicable to a multi-layer, multi-color photographic material having at least two different spectral sensitivities on a base support. Multi-layer, multi-color photographic materials usually have at least one each of a red-sensitive emulsion layer, a green-sensitive emulsion layer and a blue- sensitive emulsion layer on a base support and the order of these layers may vary depending on the need. In monochromatic or multi-color photographic materials, it is usual for the red-sensitive emulsion layer to contain a cyan-forming coupler, for the green-sensitive emulsion to contain a magenta-forming coupler, and for the blue-sensitive emulsion layer to contain a yellow-forming coupler, but different combinations may also be adopted depending on the case. Thus, in forming color photographic materials, techniques and components that are commonly employed in color photographic materials may be used (e.g. incorporating a combination of cyan, magenta and yellow couplers in an emulsion). Illustrative magenta couplers are 5-pyrazolone coupler, pyrazolobenzimidazole coupler, pyrazolotriazole coupler, cyanoacetyl coumarone coupler, and open-chain acylacetonitrile coupler. Illustrative yellow couplers are acylacetamide couplers (e.g. benzoylacetanilide and pivaloylacetanilide). Illustrative cyan couplers are naphthol and phenol couplers. These couplers are preferably rendered nondiffusible by incorporating a hydrophobic or "ballast" group within the molecule. The couplers may be of four- or two-equivalent type with respect to silver ions. They may also be colored couplers capable of effecting color correction or DIR couplers which release a development inhibitor as the process of development proceeds. Besides DIR couplers, colorless DIR coupling compounds may also be used which yield a colorless product upon coupling reaction while releasing a development inhibitor.

Known anti-fading agents may be used in the practice of the present invention. It is also possible to use color image stabilizers either alone or in combination. Known anti-fading agents include hydroquinone derivatives, gallic acid derivatives, p-alkoxyphenols, p-oxyphenolic derivatives and bisphenols.

The photographic material of the present invention may also contain uv absorbers in hydrophilic colloidal layers. Exemplary uv absorbers are aryl-substituted benzotriazole compounds, 4-thiazolidone compounds, benzophenone compounds, cinnamic acid ester compounds, butadiene compounds, benzoxazole compounds, and uv absorbing polymers. These uv absorbers may be fixed within hydrophilic colloidal layers.

The photographic material of the present invention may contain water-soluble dyes in hydrophilic colloidal layers either for use as filter dyes or for attaining various purposes such as prevention of irradiation. Useful dyes include oxonol dyes, hemioxonol dyes, styryl dyes, merocyanine dyes, cyanine dyes and azo dyes. Among these dyes, oxonol, hemioxonol and merocyanine dyes are particularly useful.

The photographic material of the present invention may also contain color fog preventing agents such as hydroquinone derivatives, aminophenol derivatives, gallic acid derivatives, ascorbic acid derivatives, etc.

In making the photographic material of the present invention, photographic emulsion layers and other hydrophilic colloidal layers may be coated onto a base support or other layers by various known coating techniques including dip coating, roller coating, curtain coating and extrusion coating. Particularly advantageous coating methods are described in U.S. Pat. Nos. 2,681,294, 2,761,791 and 3,526,528.

Common base supports may be used for the photographic material of the present invention and they include baryta paper, polyethylene coated paper, polypropylene synthetic paper, glass, cellulose acetate, cellulose nitrate, polyvinyl acetal, polypropylene, polyester (e.g. polyethylene terephthalate) film, polystyrene, etc. Suitable base supports may be selected depending on the specific use of the photographic material.

These base supports may be subbed as required.

The photographic material of the present invention may be processed by known ordinary methods after exposure. Alkali solutions containing developing agents such as hydroxybenzenes, aminophenols, aminobenzenes, etc. may be used as black-and-white developers. Such developers may also contain sulfites, carbonates, bisulfites, bromides, iodies, etc. of alkali metals. When the photographic material of the present invention is to be used in color photography, it may be subjected to color development by common color developing methods. In a reversal process, development with a black-and-white developing solution is followed by exposure to white light or treatment with a foggant-containing bath, and is finally color development is performed with an alkali developer containing a color developing agent. All processing methods known in the art may be employed without any particular limitation. A typical method comprises color development, bleach-fixing, and if necessary, washing and stabilization. Instead of bleach-fixing, bleaching and fixing may be performed separately. Color developers generally comprise alkaline aqueous solutions containing color developing agents. Known primary aromatic amine developing agents may be used as color developing agents and they may be exemplified by phenylenediamines such as 4-amino-N, N-diethylaniline, 3-methyl-4-amino-N, N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methane-sulfoamide ethylaniline, and 4-amino-3-methyl-N-ethyl-N-β-methoxyethylaniline.

Other color developing agents that may be used are described in L.F.A. Mason, Photographic Processing Chemistry, Focal Press, 1966, pp. 226–229, U.S. Pat. Nos. 2,193,015, 2,592,364, and No. JP-A-48-64933.

Color developers may contain other additives such as pH buffers, development inhibitors and antifoggants. If necessary, water softeners, preservatives, organic solvents, development accelerators, dye forming couplers, competitive couplers, foggants, auxiliary developing agents, tackiness imparting agents, polycarboxylic acid type chelating agents or antioxidants may be incorporated in color developers.

Photographic emulsion layers are usually bleached after color development. Bleaching may be performed either simultaneously with or separately from fixing. Illustrative bleaching agents are compounds of polyvalent metals such as iron (III), cobalt (IV), chromium (VI) and copper (II), peracids, quinones, and nitroso compounds.

Bleaching or bleach-fixing solutions may contain various additives such as bleach accelerators (see U.S. Pat. Nos. 3,042,520, 3,241,966, No. JP-B-45-8506 and No. JP-B-45-8836) and thiol compounds (see No. JP-A-53-65732).

The following examples are provided for the purpose of further illustrating the present invention but are in no way to be taken as limiting.

EXAMPLE 1

Emulsion EM-1 containing silver iodobromide grains with 2.6 mol% AgI was prepared using five solutions A-1, B-1, E-1, F-1 and G-1 having the compositions described below.

| | |
|---|---|
| Solution A-1 | |
| Ossein gelatin | 34.0 g |
| Distilled water | 7779 ml |
| Polyisopropylene-polyethyleneoxy-disuccinic acid ester sodium salt (10% ethanol sol.) | 20 ml |
| 4-Hydroxy-6-methyl-1,3,3a,7-tetrazaindene | 405 mg |
| 28% Aqueous ammonia | 117.3 ml |
| 56% Aqueous solution of acetic acid | 72 ml |
| Seed emulsion (average grain size, 0.27 μm) Average AgI content, 2 mol % (AgX represents silver halide throughout the following description) | equivalent to 0.271 mol of AgX |
| Solution B-1 | |
| Ossein gelatin | 18.74 g |
| Potassium bromide | 760.2 g |
| Potassium iodide | 28.4 g |
| 4-Hydroxy-6-methyl-1,3,3a,7-tetrazaindene | 1.35 g |
| Distilled water | 1574 ml |
| Solution E-1 | |
| Silver nitrate | 1148 g |
| 28% Aqueous ammonia | 937 ml |
| Distilled water | to make 1930 ml |
| Solution F-1 | |
| 25% Aqueous solution of potassium bromide | q.s. for pAg adjustment |
| Solution G-1 | |
| 56% Aqueous solution of acetic acid | q.s. for pH adjustment |

These solutions were handled in the following manner to prepare emulsion EM-1. First, solutions E-1 and B-1 were added to solution A-1 at 40° C. by the double-jet method using a mixer-agitator of the type described in No. JP-A-57-92523 and No. JP-A-57-92524 over a minimum period of 56.5 min that would not cause generation of small grains. During the performance of the double-jet method, pAg, pH and the rates of addition of E-1 and B-1 were controlled as shown in Table 1-1. The control of pAg and pH was performed by adjusting the flow rates of solutions F-1, G-1 and B-1 with a roller tube pump capable of flow rate adjustment.

Two minutes after completion of the addition of solution E-1, pAg was adjusted to 10.2 with solution G-1, an 2 more minutes later, pH was adjusted to 6.0 with solution F-1.

In the next step, desalting was performed to remove excess soluble salts by the following procedure: to the reaction solution held at 40° C., compound (I) to be identified below and $MgSO_4$ (magnesium sulfate) were added in respective amounts of 4 g and 11 g per mole of AgX, and the mixture was stirred for 5 min and thereafter left to stand. The supernatant was then discharged to make a volume of 180 cc per mole of AgX. Subsequently, pure water (40° C.) was added in an amount of 2.6 L per mole of AgX and the mixture was stirred for 4 min (washing step).

Then, $MgSO_4$ was added in an amount of 27 g per mole of AgX and the mixture was stirred and left to stand in the same manner as described above. The supernatant was discharged to effect desalting. Subsequently, the residue was dispersed in an aqueous solution containing 128.1 g of ossein gelatin and distilled water was added to make a total volume of 3000 ml.

Examination with the electron microscope showed that the product was a monodispersed emulsion having an average grain size of 0.80 μm and a variation coefficient of 10% for grain size distribution.

TABLE 1-1

| Time (min) | Rate of addition (ml/min) Solution E-1 | Solution B-1 | pAg | pH |
|---|---|---|---|---|
| 0.00 | 5.77 | 5.49 | 9.0 | 9.00 |
| 9.43 | 10.29 | 9.79 | 9.0 | 8.96 |
| 14.17 | 13.91 | 13.24 | 9.0 | 8.93 |
| 18.88 | 18.96 | 18.04 | 9.0 | 8.88 |
| 23.62 | 25.91 | 24.65 | 9.0 | 8.83 |
| 28.33 | 35.09 | 33.81 | 9.0 | 8.76 |
| 33.05 | 44.20 | 42.92 | 9.0 | 8.66 |
| 37.78 | 53.27 | 52.01 | 9.0 | 8.54 |
| 42.50 | 55.56 | 54.31 | 9.0 | 8.40 |
| 47.23 | 56.37 | 55.12 | 9.0 | 8.27 |
| 51.95 | 58.00 | 56.75 | 9.0 | 8.13 |
| 56.53 | 56.01 | 54.76 | 9.0 | 8.00 |

Emulsions EM-2 and EM-3 were prepared in the same manner as in the making of EM-1 except that solution L-1 of a spectral sensitizing dye (see below) was added after 85 wt % of the necessary amount of E-1 (solution of soluble silver salt) had been added but before completion of the addition of all its amount. In the making of EM-2, solution L-1 (see below) was done rush addition just after the addition of 85 wt % of the necessary amount of E-1, whereas in the making of EM-3, solution L-1 was done rush addition just after the addition of 95 wt % of the necessary amount of E-1. Emulsion EM-4 was prepared in the following way: solution L-1 was divided into two portions, 30% and 70%, and the former portion was added instantaneously just after 85 wt % of the necessary amount of E-1 was added whereas the latter portion was added during the washing step in the desalting process. Emulsion EM-5 was prepared with 30% of L-1 added just after 95 wt % of the necessary amount of E-1 was added, and with the remaining 70% of E-1 being added during the washing step of the desalting process.

Solution L-1

| | |
|---|---|
| Spectral sensitizer (A) | 1700 mg |
| methanol | 340 cc |
| Compound (I) | |

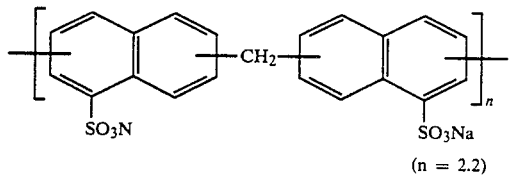

Spectral sensitizer (A)

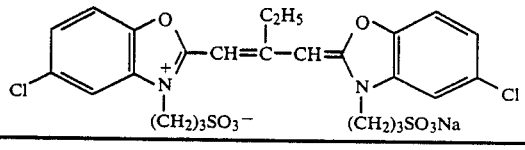

Emulsion EM-2 had an average grain size of 0.8 μm and a variation coefficient of 17%; emulsion EM-3 had an average grain size of 0.8 μm and a variation coefficient of 11%; emulsion EM-4 had an average grain size of 0.8 μm and a variation coefficient of 10%; and emulsion EM-5 had an average grain size of 0.8 μm and a variation coefficient of 10%.

Each of the emulsions thus prepared was subjected to optimum gold-sulfur sensitization in the usual manner and its sensitivity and keeping quality were evaluated. To emulsion EM-1, spectral sensitizer (A) was added before or after the step of gold-sulfur sensitization in varying amounts (see Table 1-2). As for EM-2, two additional samples were prepared that had spectral sensitizer (A) added prior to the step of gold-sulfur sensitization. Using the chemically sensitized emulsions, monolayer coated samples were prepared, each of which was composed of a single emulsion layer and a protective layer and had sensitivity to monochromatic light.

The layers in each sample were made in the following manner.

First layer

Green-sensitive emulsion layer containing 1.8 g of an emulsion that had been subjected to chemical sensitization and spectral sensitization in the way described above, 1.9 g of gelatin, and a dispersion of DNP (ditertiary nonyl phenol, 0.06 g) having dissolved therein 0.20 g of magenta coupler, or 1-(2,4,6-trichlorophenyl)-3-[3-(2,4-di-t-amylphenoxyacetamido)benzamido]-5-pyrazolone.

Second layer

Yellow filter layer containing 0.15 g of yellow colloidal silver, 1.5 g of gelatin, and a dispersion of DBP (dibutyl terephthalate, 0.11 g) having 0.2 g of antistain agent dissolved therein.

Besides the compositions described above, a gelatin hardener and a surfactant were added to each of the two photographic layers, thus making photographic sample Nos. 1-12. For further details of these samples, see Table 1-2.

For measurement of sensitometric performance (sensitivity and fog), each of the samples was subjected to wedge exposure in the usual manner and processed by the following scheme.

| Processing steps | |
|---|---|
| Color development | 3 min 15 sec |
| Bleaching | 6 min 30 sec |
| Washing | 3 min 15 sec |
| Fixing | 6 min 30 sec |
| Washing | 3 min 15 sec |
| Stabilizing | 1 min 30 sec |
| Drying | |

The processing solutions employed had the following recipes.

| | |
|---|---|
| Color developer | |
| 4-Amino-3-methyl-N-(β-hydroxyethyl)-aniline sulfate | 4.75 g |
| Anhydrous sodium sulfite | 4.25 g |
| Hydroxylamine hemisulfate | 2.0 g |
| Anhydrous potassium carbonate | 37.5 g |
| Sodium bromide | 1.3 g |
| Nitrilotriacetic acid trisodium salt (monohydrate) | 2.5 g |
| Potassium hydroxide | 1.0 g |
| Water | to make 1,000 ml |
| Bleaching solution | |
| Ethylene diaminetetraacetic acid iron ammonium salt | 100.0 g |
| Ethylene diaminetetraacetic acid diammonium salt | 10.0 g |
| Ammonium bromide | 150.0 g |
| Glacial acetic acid | 10.0 ml |
| Water | to make 1,000 ml |
| pH | adjusted to 6.0 with aqueous ammonia |
| Fixing solution | |
| Ammonium thiosulfate | 175.0 g |
| Anhydrous ammonium sulfite | 8.6 g |
| Sodium metasulfite | 2.3 g |
| Water | to make 1,000 ml |
| pH | adjusted to 6.0 with acetic acid |
| Stabilizing solution | |
| Formalin (37% aq. sol.) | 1.5 ml |
| Konidax (Konica Corp.) | 7.5 ml |
| Water | to make 1,000 ml |

The developed samples were subjected to sensitometry with green light for fog and sensitivity measurements.

Fog: Minimum optical density on the "characteristic curve" obtained by sensitometry (the greater this value, the higher the degree of fogging, which is undesired)

Sensitivity: The reciprocal of the amount of exposure (anti-logarithmic value) necessary to impart an optical density of fog +0.1 (the data in Table 1-2 and other relevant tables in the following examples are shown in terms of relative values, with the sensitivity for a comparative emulsion being taken as 100; the greater the value, the higher the sensitivity, which is preferred)

Data on two kinds of sensitivity, immediate sensitivity and sensitivity after accelerated aging, are shown in Table 1-2 for each sample. "Immediate sensitivity" is the sensitivity obtained by performing exposure and development after leaving the sample for 10 h in a hot and humid atmosphere (40° C.×80% r.h.) following the coating and drying of an emulsion of interest. "Sensitivity after accelerated aging" is the sensitivity obtained when the sample was left to stand for 24 h under accelerated aging conditions of 50° C.×80% r.h.

As Table 1-2 shows, the photographic materials using the emulsions of the present invention were improved in keeping quality over the comparative samples since they exhibited higher values of both immediate sensitivity and sensitivity after accelerated aging. Sample Nos. 7 and 10 which employed emulsions that were prepared with a sensitizing dye being added only during grain growth were improved in terms of keeping quality. However, the immediate sensitivity of these samples was lower than that of the samples employing the emulsions of the present invention. Hence, sample Nos. 7 and 10 failed to fully satisfy the requirements for high sensitivity and good keeping quality. The performance of the emulsions employed in these samples was in no way improved by adding a dye before chemical sensitization (see data on sample Nos. 8 and 9).

TABLE 1-2

| Sample No. | Emulsion | Amount of sensitizing dye (mg/mol AgX) | Timing of addition of spectral sensitizing dye | Sensitivity to green light** immediate | Sensitivity to green light** after accelerated aging | Remarks |
|---|---|---|---|---|---|---|
| 1 | EM-1 | 220 | before addition of gold-sulfur sensitizing dyes | 91 | 50 | comparison |
| 2 | EM-1 | 244 | before addition of gold-sulfur sensitizing dyes | 100 | 51 | comparison |
| 3 | EM-1 | 268 | before addition of gold-sulfur sensitizing dyes | 94 | 49 | comparison |
| 4 | EM-1 | 220 | after addition of gold-sulfur sensitizing dyes | 83 | 40 | comparison |
| 5 | EM-1 | 244 | after addition of gold-sulfur sensitizing dyes | 90 | 42 | comparison |
| 6 | EM-1 | 268 | after addition of gold-sulfur sensitizing dyes | 90 | 45 | comparison |
| 7 | EM-2 | 244 | after addition of 85 wt % of the necessary amount | 96 | 63 | comparison |

TABLE 1-2-continued

| Sample No. | Emulsion | Amount of sensitizing dye (mg/mol AgX) | Timing of addition of spectral sensitizing dye | Sensitivity to green light** immediate | after accelerated aging | Remarks |
|---|---|---|---|---|---|---|
| | | | of E-1 | | | |
| 8 | EM-2 | 244 + 14* | after addition of 85 wt % of the necessary amount of E-1 + * before addition of gold-sulfur sensitizing dyes | 101 | 61 | comparison |
| 9 | EM-2 | 244 + 28* | after addition of 85 wt % of the necessary amount of E-1 + * before addition of gold-sulfur sensitizing dyes | 85 | 60 | comparison |
| 10 | Em-3 | 244 | after addition of 95 wt % of the necessary amount of E-1 | 103 | 63 | comparison |
| 11 | EM-4 | 244 | after addition of 85 wt % of the necessary amount of E-1 + * during the washing step of desalting process | 110 | 68 | the invention |
| 12 | EM-5 | 244 | after addtion of 95 wt % of the necessary amount of E-1 + * during the washing step of desalting process | 118 | 70 | the invention |

*The plus "+" sign denotes addition of a sensitizing dye at two points of time, and the amounts added at respective points of time are also connected by plus sign (which applies throughout the relevant tables in the following examples).

**Specific sensitivity, with the immediate sensitivity of sample No. 2 being taken as 100.

EXAMPLE 2

Emulsion EM-6 having a multilayer structure composed of an inner core of high iodide content, an intermediate layer and an outer shell was prepared using the solutions described below, with EM-1 (see Example 1) being used as speed emulsion.

| | |
|---|---|
| Solution A-2 | |
| Ossein gelatin | 31 g |
| Distilled water | 6912 ml |
| Polyisopropylene-polyethyleneoxydisuccinate ester sodium salt (10% ethanol sol.) | 15 ml |
| 4-Hydroxy-6-methyl-1,3,3a,7-tetrazaindene | 500 mg |
| 28% Aqueous ammonia | 470 ml |
| 56% Aqueous solution of acetic acid | 294 ml |
| Seed emulsion | equivalent to 0.452 mol of AgX |
| Solution B-2 | |
| Ossein gelatin | 7 g |
| Potassium bromide | 247.8 g |
| Potassium iodide | 61.0 g |
| 4-Hydroxy-6-methyl-1,3,3a,7-tetrazaindene | 560 mg |
| Distilled water | 477 ml |
| Solution C-2 | |
| Ossein gelatin | 13.3 g |
| Potassium bromide | 526.3 g |
| Potassium iodide | 38.6 g |
| 4-Hydroxy-6-methyl-1,3,3a,7-tetrazaindene | 1064 mg |
| Distilled water | 908 ml |
| Solution D-2 | |
| Ossein gelatin | 8 g |
| Potassium bromide | 333.2 g |
| 4-Hydroxy-6-methyl-1,3,3a,7-tetrazaindene | 640 mg |
| Distilled water | 547 ml |

-continued

| | |
|---|---|
| Solution E-2 | |
| Silver nitrate | 1129 g |
| 28% Aqueous ammonia | 884 ml |
| Distilled water | to make 1899 cc |
| Solution F-2 | |
| 25% Aqueous solution of potassium bromide | q.s. for pAg adjustment |
| Solution G-2 | |
| 56% Aqueous solution of acetic acid | q.s. for pH adjustment |

Solutions E-2 and B-2 were added to solution A-2 at 50° C. by the double-jet method using a mixer-agitator of the type described in No. JP-A-57-92523 and No. JP-A-57-92524 over 76.3 min. As soon as the addition of solution B-2 was completed, the addition of solution C-2 was started and completed 40.3 min later, whereupon the addition of solution D-2 was started and completed 26.4 min later. During the performance of the double-jet method, pAg, pH and the rates of addition of E-2, B-2 C-2 and D-2 were controlled as shown in Table 2-1. The control of pAg and pH was performed by adjusting the flow rates of solutions F-2 and G-2 with a roller tube pump capable of flow rate adjustment.

Two minutes after completion of the addition of solution E-2, pH was adjusted to 6.0 with solution G-2.

In the next step, desalting was performed to remove excess soluble salts by the following procedures: to the reaction solution held at 40° C., compound (I) and $MgSO_4$ were added in respective amounts of 4.5 g and 11 g per mole of AgX, and the mixture was stirred for 3 min and thereafter left to stand. The supernatant was then discharged to make a volume of 180 cc per mole of AgX. Subsequently, pure water (40° C.) was added in an amount of 2 L per mole of AgX and the mixture was stirred for 5 min (first washing step). Then, $MgSO_4$, was added in an amount of 12 g per mole of AgX and the mixture was stirred and left to stand in the same manner as described above. The supernatant was discharged. Washing was done once more in the same manner (second washing step). $MgSO_4$ was added in an amount of 12 g per mole of AgX and the supernatant was discharged in a similar way to effect desalting. Subsequently, the residue was dispersed in an aqueous solution containing 127 g of ossein gelatin and distilled water was added to make a total volume of 3000 ml.

Examination with the electron microscope showed that the product (EM-6) was a monodispersed emulsion having an average grain size of 2.0 μm and a variation coefficient of 11% for grain size distribution, with the grains having an octahedral crystal habit. The occurrence of twinned crystals was negligible.

Emulsion EM-6 was a core-shell type AgIBr emulsion of a multilayer structure in which the AgI content decreased from the center outward in the order of 15 mol %, 5 mol % and 0 mol %.

Emulsion EM-7 was prepared in the same manner as in the making of EM-6 except that solution L-2 of spectral sensitizing dyes (see below) was added over 3 min immediately after 95 wt % of the necessary amount of E-2 (solution of soluble silver salt) had been added.

Emulsion EM-8 was prepared with 40% of solution L-2 being added over 3 min after 95 wt % of the necessary amount of E-2 had been added, and with the remainder (60%) of L-2 being added during the first washing step. Emulsion EM-9 was prepared with 10% of solution L-2 being done rush addition just after 95 wt % of the necessary amount of E-2 had been added, and with the remainder (90%) of L-2 being added during the first washing step. Emulsion EM-10 was prepared in the same manner except that the remaining 90% of L-2 was added during the second washing step. Emulsions EM-8 to EM-10 were prepared in entirely the same manner as in the making of emulsion EM-6 except for the addition of solution L-2. Emulsion EM-11 was prepared in entirely the same manner as in the making of EM-6 except that solution L-2 was added during the second washing step. Emulsion EM-8 had a variation coefficient of 16% for grain size distribution. Other features of emulsions EM-7 to EM-11 were similar to those of EM-6.

Solution L-2

| | |
|---|---|
| Spectral sensitizer (B) | 350 mg |
| Spectral sensitizer (C) | 290 mg |
| Methanol | 320 ml |

Spectral sensitizer (B)

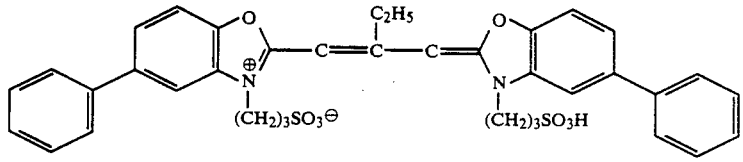

Spectral sensitizer (C)

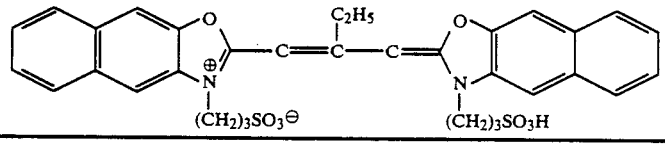

TABLE 2-1

| Time (min) | Rate of addition (ml/min) E-2 | B-2 | C-2 | D-2 | pAg | pH |
|---|---|---|---|---|---|---|
| 0.00 | 3.79 | 3.80 | — | — | 8.90 | 9.00 |
| 20.49 | 5.50 | 5.51 | — | — | 8.90 | 9.00 |
| 40.74 | 7.61 | 7.63 | — | — | 8.90 | 9.00 |
| 60.37 | 9.75 | 9.78 | — | — | 8.90 | 9.00 |
| 76.26 | 11.66 | 11.68 | 11.68 | — | 8.90 | 9.00 |
| 89.32 | 17.61 | — | 23.39 | — | 9.42 | 8.70 |
| 98.64 | 26.12 | — | 55.37 | — | 9.94 | 8.40 |
| 107.80 | 21.74 | — | 23.09 | — | 10.20 | 8.20 |
| 116.58 | 21.25 | — | 22.58 | 22.58 | 10.20 | 8.02 |
| 122.86 | 20.82 | — | — | 22.12 | 10.20 | 7.90 |
| 132.95 | 20.47 | — | — | 21.75 | 10.20 | 7.70 |
| 137.55 | 20.57 | — | — | 21.85 | 10.20 | 7.61 |
| 143.02 | 20.97 | — | — | 22.27 | 10.20 | 7.50 |

Each of the emulsions thus prepared was subjected to optimum gold-sulfur sensitization in the usual manner. Before addition of chemical sensitizing dyes, spectral sensitizing dyes B and C were added to emulsion EM-6 in amounts that were equal, per mole of silver, to those of the dyes added to EM-7 through EM-11.

Using the chemically sensitized emulsions, monolayer coated samples Nos. 13–18 each having sensitivity to monochromatic light were prepared. The emulsion layers in the respective samples were prepare as in Example 1.

As in Example 1, all samples were measured for immediate sensitivity to green light and sensitivity after accelerated aging. The results are shown in Table 2–2.

TABLE 2-2

| Sample No. | Emulsion | Timing of addition of spectral sensitizing dyes | Sensitivity to green light* immediate | after accelerated aging | Remarks |
|---|---|---|---|---|---|
| 13 | EM-6 | before addition of gold-sulfur sensitizing dyes | 100 | 45 | comparison |
| 14 | EM-7 | after addition of 95 wt % of the necessary amount of E-1 | 105 | 65 | comparison |
| 15 | EM-8 | after addition of 95 wt % of the necessary amount of E-2 (40% of L-2) + during the first washing step (60% of L-2) | 109 | 74 | the invention |
| 16 | EM-9 | after addition of 95 wt % of the necessary amount of E-2 (10% of L-2) + during the first washing step (90% of L-2) | 114 | 73 | the invention |
| 17 | EM-10 | after addition of 95 wt % of the necessary amount of E-2 (10% of L-2) + during the second washing step (90% of L-2) | 112 | 70 | the invention |
| 18 | EM-11 | during the second washing step | 110 | 56 | comparison |

*Specific sensitivity, with the sensitivity of sample No. 13 being taken as 100.

As in Example 1, the photographic materials employing the emulsions of the present invention had high "immediate sensitivity" and were improved in keeping quality.

Sample No. 18 employing an emulsion that had spectral sensitizing dyes added only at the time of desalting step was not so much improved as the samples of the present invention with respect to keeping quality.

EXAMPLE 3

Emulsions EM-6 thru EM-11 prepared in Example 2 were chemically sensitized as in Example 2. Using these emulsions, color photographic materials (sample Nos. 19–24) each consisting of 9 layers including three kinds of light-sensitive layers, i.e. blue-sensitive, green-sensitive and red-sensitive layers, were prepared in the manner described below. The differences between chemically sensitized emulsions EM-6 thru EM-11 were reflected only in a green-sensitive layer (layer 5). The other light-sensitive layers employed completely identical emulsions in all samples.

The compositions of the photographic samples were as follows. Transparent bases composed of subbed cellulose triacetate films and which had an anti-halation layer (containing 0.40 g of black colloidal silver and 3.0 g of gelatin) were coated successively with the layers identified below (the amounts of additives incorporated in photographic materials are expressed in terms of values per square meter, and the amounts of silver halide emulsions and colloidal silver are indicated in terms of silver).

Layer 1: Less red-sensitive emulsion layer containing 1.4 g of silver iodobromide (7 mol % AgI) emulsion provided with low sensitivity to red light, 1.2 g of gelatin, and 0.65 g of tricresyl phosphate (TCP) having dissolved therein the following components: 0.8 g of 1-hydroxy-4-(β-methoxyethylaminocarbonylmethoxy)-N-[δ-(2,4-di-t-amylphenoxy)butyl]-2-naphthoamide (hereinafter referred to as C-1), 0.075 g of 1-hydroxy-4-[4-(1-hydroxy-δ-acetoamido-3,6-disulfo-2naphthylazo)phenoxy]-N-[δ-(2,4-di-t-amylphenoxy)butyl]-2-naphthoamide disodium (hereinafter referred to as a colored cyan coupler or CC-1), 0.015 g of 1-hydroxy-2-[δ-(2,4-di-t-amylphenoxy)n-butyl]-naphthoamide and 0.07 g of 4-octadecylsuccinimido-2-(1-phenyl-5-tetrazolylthio)-1-indanone (hereinafter referred to as a DIR compound, or D-1).

Layer 2: Highly red-sensitive emulsion layer containing 1.3 g of silver iodobromide emulsion provided with high sensitivity to red light, 1.2 g of gelatin, and 0.23 g of TCP having dissolved therein 0.21 g of a cyan coupler (C-1) and 0.02 g of a colored cyan coupler (CC-1).

Layer 3: Intermediate layer containing 0.8 g of gelatin and 0.04 g of n-dibutyl phthalate (hereinafter abbreviated as DBP) having 0.07 g of 2,5-di-t-octyl hydroquinone (hereinafter referred to as an anti-stain agent, or HQ-1) dissolved therein.

Layer 4: Less green-sensitive emulsion layer containing 0.80 g of silver iodobromide (6 mol % AgI) emulsion provided with low sensitivity to green light, 2.2 g of gelatin, and 0.95 g of TCP having dissolved therein the following components: 0.8 g of 1-(2,4,6-trichlorophenyl)3-[3-(2,4-di-t-amylphenoxyacetamido)benzamido]-5-pyrazolone (hereinafter referred to as a magenta coupler, or M-1), 0.15 g of 1-(2,4,6-trichlorophenyl)-4-(1-naphthylazo)-3-(2-chloro-5-octadecenylsuccinimidoanilino)-5-pyrazolone (hereinafter referred to as a colored magenta coupler, or CM-1), and 0.016 g of a DIR compound (D-1).

Layer 5: Highly green-sensitive emulsion layer containing 1.8 g of silver iodobromide emulsion provided with sensitivity to green light (for its type, see Table 3–1 below), 1.9 g of gelatin, and 0.25 g of TCP having 0.20 g of a magenta coupler (M-1) and 0.049 g of a colored magenta coupler (CM-1) dissolved therein.

Layer 6: Yellow filter layer containing 0.15 g of yellow colloidal silver, 1.5 g of gelatin, and 0.11 g of DBP having 0.2 g of antistain agent (HQ-1) dissolved therein.

Layer 7: Less blue-sensitive emulsion layer containing 0.2 g of silver iodobromide (4 mol % AgI) emulsion provided with low sensitivity to blue light, 1.9 g of gelatin, and 0.6 g of TCP having 1.5 g of α-pivaloyl-α-(1-benzyl-2-phenyl-3,5-dioxoimidazolidine-4-yl)-2'-chloro-5'-[α-dodecyloxycarbonyl)ethoxycarbonyl-]acetanilide (hereinafter abbreviated as Y-1) dissolved therein.

Layer 8: Highly blue-sensitive emulsion layer containing 1.0 g of silver iodobromide emulsion provided with high sensitivity to blue light, 1.5 g of gelatin, and 0.65 g of TCP having 1.30 g of yellow coupler (Y-1) dissolved therein.

Layer 9: Protective layer containing 2.3 g of gelatin.

Measurement of multilayer sensitivity

The multilayer color photographic materials thus prepared were exposed to white light through an optical wedge in the usual manner and processed by the scheme already described in Example 1. The processed samples were subjected to sensitometry to measure their sensitivity to green light (for the definition of sensitivity, see the relevant explanation given for single-layer coated samples having sensitivity to monochromatic light).

As in Example 1, the samples were measured for their "immediate sensitivity" and "sensitivity after accelerated aging". The results are shown in Table 3-1, from which one can see that the samples employing the emulsions of the present invention were improved in terms of both immediate sensitivity and keeping quality. Table 3-1 also shows that the improvement over comparative samples was greater than in Example 2 in which single-layer coated samples were tested. This suggests that the present invention would be more effective in multilayer systems such as color photographic materials than in single-layer systems.

TABLE 3-1

| Sample No. | Emulsion (layer 5) | Timing of addition of spectral sensitizing dyes in the emulsion in layer 5 | Green sensitivity* immediate | Green sensitivity* after accelerated aging | Remarks |
|---|---|---|---|---|---|
| 19 | EM-6 | same as in sample No. 13 | 100 | 35 | comparison |
| 20 | EM-7 | same as in sample No. 14 | 109 | 56 | comparison |
| 21 | EM-8 | same as in sample No. 15 | 118 | 64 | the invention |
| 22 | EM-9 | same as in sample No. 16 | 125 | 64 | the invention |
| 23 | EM-10 | same as in sample No. 17 | 130 | 73 | the invention |
| 24 | EM-11 | same as in sample No. 18 | 120 | 46 | comparison |

*Specific sensitivity, with the immediate sensitivity of sample No. 19 being taken as 100.

EXAMPLE 4

Resistance to blackening under pressure was examined for multilayer color photographic material samples No. 19 to No. 23 which were prepared in Example 3. In preparation for the testing, the samples were placed under a hot and humid condition (40° C.×80% r.h.) for 10 h and rehumidified for 55% r.h. at 23° C. over 2 h. Under this condition, each sample was bent through an angle of about 360 degrees at a curvature radius of 4 mm and thereafter processed by the method described in Example 1.

"Blackening under pressure" is a phenomenon in which an area of a photographic material that has been placed under pressure (bent in the example being discussed) will blacken or darken (assume color in color development) although it is yet to be exposed. The degree of blackening that occurred in the green-sensitive layers in the samples tested is shown in Table 4-1 below. The degree of blackening is indicated by ΔD, or the difference between the density in the darkened area and the density of fog. Each of the samples prepared in Example 3 contained two green-sensitive layers (layers 4 and 5) but the emulsion in layer 4 was common to all samples and layer 4 was less sensitive than layer 5. Hence, it may safely be concluded that the differences in the degree of blackening shown in Table 4-1 would largely reflect the differences among emulsions EM-6 thru EM-11 employed in layer 5.

TABLE 4-1

| Sample No. | Degree of blackening, ΔD | Remarks |
|---|---|---|
| 19 | 0.70 | comparison |
| 20 | 0.84 | comparison |
| 21 | 0.50 | the invention |
| 22 | 0.33 | the invention |
| 23 | 0.34 | the invention |

As one can see from Table 4-1, the resistance to blackening under pressure could be markedly improved by using the emulsions of the present invention. Sample No. 20 using an emulsion that was prepared with sensitizing dyes added only in the process of grain growth proved to be less resistant than sample No. 19 which employed an emulsion prepared without adding spectral sensitizing dyes at any of the points of time specified by the present invention. This is another evidence that demonstrates the superiority of the present invention over the prior art.

EXAMPLE 5

Emulsion EM-12 was prepared by the method described in the specification of Japanese Patent Application No. 62-3435 using the six solutions described below. This emulsion was comprised of grains having an average size of 0.65 μm and an average AgI content of 7.164 mol %.

| | |
|---|---|
| Solution A-5 | |
| Ossein gelatin | 45 g |
| Polyisopropylene-polyethylene oxy-disuccinate ester sodium salt (10% ethanol aq. sol.) | 30 ml |
| Potassium iodide | 330 g |
| Distilled water | 2800 ml |
| Solution B-5 | |
| Seed emulsion (average grain size, 0.27 μm average AgI content, 2 mol %) | equivalent to 0.506 mol AgX |
| 56% Aqueous solution of acetic acid | 112.5 cc |
| 28% Aqueous ammonia | 175.5 cc |
| TAI | 600 mg |
| Distilled water | to make 5,000 ml |

-continued

| | |
|---|---|
| Solution C-5 | |
| Silver nitrate | 1790 g |
| 28% Aqueous ammonia | 1460 ml |
| Distilled water | to make 3,011 ml |
| Solution D-5 | |
| Ossein gelatin | 50 g |
| Potassium bromide | 2082.5 g |
| TAI | 5.338 g |
| Distilled water | to make 5,000 ml |
| Solution E-5 | |
| 20% Aqueous solution of potassium bromide | q.s. for pAg adjustment |
| Solution F-5 | |
| 56% Aqueous solution of acetic acid | q.s. for pH adjustment |

Using a mixer-stirrer of the type described in No. JP-A-57-92523 and No. JP-A-57-92524, 201 ml of solution C-5 was added to solution A-5 at 40° C. over 1 min so as to produce AgI grains. Examination under the electron microscope showed that the AgI grains produced had a size of about 0.05 μm. Following the production of AgI grains, solution B-5 was added. Subsequently, solutions C-5 and D-5 were added by the double-jet method, with pAg, pH and the flow rates of the respective solutions being controlled as shown in Table 5-1. Control of pAg and pH during the application of the double-jet method was performed by adjusting the flow rates of solutions E-5 and F-5 with a roller tube pump capable of flow rate adjustment. Two minutes after completion of the addition of solution C-5, pAg was adjusted to 10.4 with solution E-5, and 2 more min later, pH was adjusted to 6.0 with solution F-5.

In the next place, desalting and washing were performed in the same manner as in Example 1 and the residue was dispersed in an aqueous solution containing 197.4 g of ossein gelatin. Distilled water was added to make a total volume of 3,000 ml, thus obtaining emulsion EM-12.

TABLE 5-1

| Conditions of Grain Growth for EM-12 | | | | |
|---|---|---|---|---|
| | | | Rate of addition (ml/min) | |
| Time (min) | pH | pAg | Solution C-5 | Solution D-5 |
| 0.00 | 9.00 | 8.55 | 22.1 | 22.1 |
| 7.01 | 8.93 | 8.55 | 18.8 | 18.8 |
| 18.45 | 8.77 | 8.55 | 30.4 | 30.4 |
| 30.22 | 8.55 | 8.55 | 41.5 | 41.5 |
| 33.98 | 8.46 | 8.55 | 51.5 | 51.5 |
| 35.92 | 8.40 | 8.55 | 65.7 | 67.6 |
| 38.19 | 8.31 | 9.04 | 77.4 | 84.3 |
| 39.60 | 8.25 | 9.38 | 83.7 | 97.2 |
| 41.64 | 8.18 | 9.79 | 55.8 | 82.7 |
| 44.07 | 8.11 | 10.12 | 38.7 | 79.5 |
| 44.83 | 8.10 | 10.20 | 35.6 | 36.4 |
| 61.76 | 7.80 | 10.20 | 30.4 | 31.1 |
| 82.4 | 7.50 | 10.20 | 24.5 | 25.1 |

Emulsion EM-12 consisted of highly monodispersed grains (0.65 μm) with rounded apexes and having a tetradecahedral crystal habit.

Emulsion EM-13 was prepared in entirely the same manner as in the making of EM-12 except that a solution of spectral sensitizers (solution L-5 to be identified below) was done rush addition just after 95 wt % of the necessary amount of C-5 (solution of soluble silver salt) had been added. Emulsion EM-13 had the same characteristics as those of EM-12 except that the grain size distribution was slightly broader.

Emulsion EM-14 was prepared in entirely the same manner as in the making of EM-12 except that when 95 wt % of the necessary amount of solution C-5 had been added, 5% of solution L-5 was added, with the remaining 95% being added during the washing step of the desalting process. Emulsion EM-14 had the same characteristics as those of EM-12.

| | |
|---|---|
| Solution L-5 | |
| Spectral sensitizer D | 159 mg |
| Spectral sensitizer E | 53 mg |
| Methanol | 106 cc |

Spectral sensitizer D

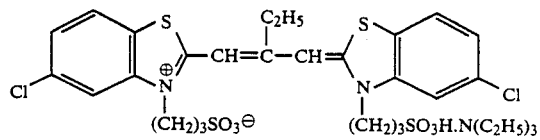

Spectral sensitizer E

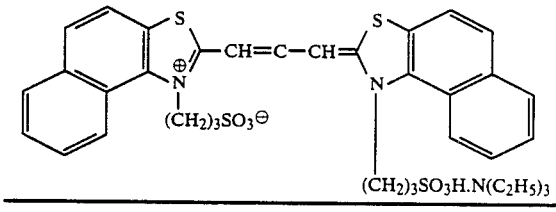

The three emulsions were subjected to optimum gold-sulfur sensitization in the usual manner. Before the addition of chemical sensitizers, emulsion EM-12 was spectrally sensitized with dyes D and E that were added in amounts that were equal, per mole of silver, to those incorporated in emulsions EM-13 and EM-14.

Single-layer coated photographic materials that were sensitive to monochromatic light were prepared as in Example 1 using the chemically sensitized emulsions EM-12 thru EM-14. The immediate sensitivity of each sample and its sensitivity after accelerated aging were measured as in Example 1 except that exposing light was red light, rather than green light. The results are shown in Table 5-2 below.

TABLE 5-2

| | | | Sensitivity to red light* | | |
|---|---|---|---|---|---|
| Sample No. | Emulsion | Timing of addition of sensitizing dyes | immediate | after accelerated aging | Remarks |
| 25 | EM-12 | before addition of gold-sulfur sensitizing dyes | 100 | 65 | comparison |
| 26 | EM-13 | after addition of 95 wt % of the necessary amount of E-5 | 95 | 78 | comparison |

TABLE 5-2-continued

| Sample No. | Emulsion | Timing of addition of sensitizing dyes | Sensitivity to red light* immediate | after accelerated aging | Remarks |
|---|---|---|---|---|---|
| 27 | EM-14 | after addition of 95 wt % of the necessary amount of E-5 (5% of L-5) + during washing step (95% of L-5) | 108 | 88 | the invention |

*Specific sensitivity, with the immediate sensitivity of sample No. 25 being taken as 100.

The above data shows that the concept of the present invention is also effective when applied to the making of emulsions as in Example 5 by the method of growth described in the specification of Japanese Patent Application No. 62-3435.

As described on the foregoing pages, the present invention successfully solves the problems associated with the prior art and provides a silver halide photographic material that is improved in spectral sensitivity, keeping quality and resistance to blackening under pressure.

What is claimed is:

1. A silver halide photographic material having silver halide emulsion layers, at least one of which contains a silver halide emulsion that has been prepared in such a way that a spectral sensitizing dye is added after 85 wt % of the soluble silver salt in solution that is to be added during ripening of silver halide emulsion has been added but before the start of a desalting step, and that a spectral sensitizing dye which may be the same or different from the first added dye is added during said desalting step wherein at least 50% of the total amount of the spectral sensitizing dye is added during the desalting step.

2. A silver halide photographic material according to claim 1 wherein said desalting step is performed by a flocculation method using a sulfate salt or an anionic polymer as a desalting agent.

3. A silver halide photographic material according to claim 1 wherein the addition of a spectral sensitizing dye during the ripening of silver halide emulsion is effected within the period from the time around which the formation of grains is substantially completed to the time when said desalting step is started.

4. A silver halide photographic material according to claim 1 wherein the addition of a spectral sensitizing dye during said desalting step is prior to the addition of post-gelatin following said desalting step.

5. A silver halide photographic material according to claim 1 wherein the addition of a spectral sensitizing dye during said desalting step is effected during the step of emulsion washing by a flocculation method.

6. A silver halide photographic material according to claim 1 wherein a spectral sensitizing dye is added to said silver halide emulsion following said desalting step prior to and/or after chemical sensitization.

7. A silver halide photographic material according to claim 1 wherein a spectral sensitizing dye is added to said silver halide emulsion before the start of addition of a solution of soluble silver salt and/or a solution of soluble halide but before 85 wt % of said soluble silver salt in solution that needs to be added has been added.

8. A silver halide photographic material according to claim 1 wherein said spectral sensitizing dyes are added as solutions in water or an organic solvent.

9. A silver halide photographic material according to claim 1 wherein said spectral sensitizing dyes are added as dispersions in a water-insoluble solvent.

10. A silver halide photographic material according to claim 1 wherein said spectral sensitizing dyes are added with their appropriate amounts being added either all at once or in divided portions or added continuously over a certain period of time.

11. A silver halide photographic material according to claim 1 wherein the amount of spectral sensitizing dye to be added during said desalting step occupies at least 80% of the total amount of the spectral sensitizing dyes to be used.

12. A silver halide photographic material according to claim 1 wherein the total amount of the spectral sensitizing dyes to be used ranges from $5\times10^{-7}$ to $1\times10^{-1}$ mole per mole of AgX.

13. A silver halide photographic material according to claim 1 wherein said spectral sensitizing dyes are selected from the group consisting of cyanine dyes, merocyanine dyes, complex cyanine dyes, complex merocyanine dyes, holopolar cyanine dyes, hemicyanine dyes, styryl dyes and hemioxanol dyes.

14. A silver halide photographic material according to claim 1 wherein said spectral sensitizing dyes are selected from the group consisting of cyanine dyes, merocyanine dyes and complex merocyanine dyes.

15. A silver halide photographic material according to claim 1 wherein said silver halide emulsion is a monodispersed emulsion.

16. A silver halide photographic material according to claim 1 wherein the silver halide emulsion layers are coated to provide a silver deposit ranging from 1,000 to 15,000 mg/m$^2$.

17. A silver halide photographic material according to claim 1 wherein the silver halide emulsion layers are coated to provide a silver deposit ranging from 2,000 to 10,000 mg/m$^2$.

18. A silver halide photographic material according to claim 1 wherein said silver halide emulsion comprises silver halide grains having an average grain size of 0.05–8.0 μm.

19. A silver halide photographic material according to claim 1 wherein said silver halide emulsion comprises silver halide grains having an average grain size of 0.2–3.0 μm.

20. A silver halide photographic material according to claim 1 wherein said silver halide emulsion is composed of a mixture of at least two types of emulsions having different average grain sizes and sensitivities.

21. A silver halide photographic material according to claim 1 wherein said silver halide emulsion contains silver halide grains of a multilayer structure.

22. A silver halide photographic material according to claim 1 wherein said silver halide emulsion contains silver halide grains that are prepared by a method of making an emulsion having a mixed crystal within and/or between silver halide grains in such a way that silver halide grains having a solubility product less than the minimum solubility product in the silver halide as the component of said mixed crystal are allowed to be present until the supply of silver halide producing iodine for creating said mixed crystal is completed.

* * * * *